US008393172B2

(12) United States Patent
Sato et al.

(10) Patent No.: US 8,393,172 B2
(45) Date of Patent: Mar. 12, 2013

(54) HEAT PUMP DRYING MACHINE

(75) Inventors: Keiji Sato, Moriguchi (JP); Haruhisa Yamasaki, Moriguchi (JP); Eiji Fukuda, Moriguchi (JP); Yoshiaki Noguchi, Moriguchi (JP); Tetsuya Masuda, Moriguchi (JP); Hiroyuki Kuribara, Moriguchi (JP); Satoshi Imai, Moriguchi (JP); Toshikazu Ishihara, Moriguchi (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 656 days.

(21) Appl. No.: 12/585,942

(22) Filed: Sep. 29, 2009

(65) Prior Publication Data

US 2010/0077787 A1 Apr. 1, 2010

(30) Foreign Application Priority Data

Sep. 30, 2008 (JP) ..... 2008-253356
Sep. 30, 2008 (JP) ..... 2008-253357

(51) Int. Cl.
*F25B 13/00* (2006.01)

(52) U.S. Cl. ..... 62/324.1; 62/160; 62/228.4; 62/238.7; 34/595; 34/201

(58) Field of Classification Search ..... 62/160, 62/238.6–238.7, 228.1, 228.4, 229; 34/595, 34/601, 610
See application file for complete search history.

(56) References Cited

U.S. PATENT DOCUMENTS 4,882,908 A * 11/1989 White ..... 62/155
5,074,120 A * 12/1991 Kitamoto ..... 62/156
6,035,551 A * 3/2000 Scheufler et al. ..... 34/475
6,792,694 B2 * 9/2004 Lapierre ..... 34/446
7,055,262 B2 * 6/2006 Goldberg et al. ..... 34/86
7,191,543 B2 * 3/2007 Yakumaru et al. ..... 34/77
7,290,600 B2 * 11/2007 Gavula ..... 165/231
2005/0278972 A1 * 12/2005 Maruca ..... 34/201
2007/0199338 A1 * 8/2007 Evans et al. ..... 62/228.4
2008/0052951 A1 * 3/2008 Beaulac ..... 34/549

FOREIGN PATENT DOCUMENTS

JP A-63-129238 6/1988
JP A-5-149634 6/1993
JP A-2004-313765 11/2004
JP A-2006-75217 3/2006
JP A-2008-86693 4/2008

OTHER PUBLICATIONS

Hanlon, Paul C., Compressor Handbook, 2001, McGraw-Hill, A.13.*
Nov. 27, 2012 Office Action issued in Japanese Patent Application No. 2008-253356 (with translation).
Nov. 27, 2012 Office Action issued in Japanese Patent Application No. 2008-253357 (with translation).

* cited by examiner

*Primary Examiner* — Cheryl J Tyler
*Assistant Examiner* — David Teitelbaum
(74) *Attorney, Agent, or Firm* — Oliff & Berridge, PLC

(57) ABSTRACT

An heat pump drying machine has a normal dry mode (e.g., compression ratio is equal to or greater than 3) for operating a compressor at a predetermined dry operation frequency and an energy saving dry mode (e.g., compression ratio is equal to or greater than 2.3 and is less than 3) for operating the compressor at an energy saving operation frequency that is lower than the dry operation frequency. A control device is provided to control an operation frequency of the compressor 5so that the two dry operation modes are switched to each other. The control device can execute the control for increasing the operation frequency of the compressor to the dry operation frequency during the operation of the energy saving dry mode.

5 Claims, 6 Drawing Sheets

HEAT PUMP DRYING MACHINE

INCORPORATION BY REFERENCE

The present application claims priority under 35 U.S.C. §119 to Japanese Patent Application No. 2008-253357 filed on Sep. 30, 2008 and Japanese Patent Application No. 2008-253356 filed on Sep. 30, 2008. The content of the applications is incorporated herein by reference in its entirety.

BACKGROUND OF THE INVENTION

1. Field of the Invention

The present invention relates to a heat pump drying machine which is provided with an accommodation room for accommodating a drying target and is configured to execute a dry operation for the drying target in the accommodation room.

2. Related Art

The heat pump drying machine is generally known to have the following configuration. The heat pump drying machine is provided with a rotary drum and a heat pump. The rotary drum accommodates a drying target. The heat pump is provided with a refrigeration circuit comprising a compressor, a radiator, an expansion device, an evaporator and the like. The heat pump drying machine is configured to operate the compressor at a predetermined operation frequency and make refrigerant discharged from the compressor flow through a radiator, the expansion unit and the evaporator. Simultaneously, the heat pump drying machine is configured to dry the drying target in the rotary drum by circulating air in an air blowing path from the radiator to the evaporator via the rotary drum (see e.g., JP-A-2008-086693 and 2006-075217).

By the way, the heat pump drying machine of this type is required to be able to execute an energy saving dry operation with an enhanced COP (coefficient of performance) in addition to a normal dry operation in which the compressor is operated at the above predetermined operation frequency. In the energy saving dry operation, power consumption is further reduced than that in the normal dry operation although a drying time is longer than that in the normal dry operation. When the energy saving dry operation of this type is executed, however, it takes a longer time as compared with the normal dry operation until the drying target is warmed and can be used as a heat absorption source in a heat pump cycle. During this period, such a condition that pressure of the compressor cannot be easily increased occurs.

Especially, when the external temperature is low in some conditions (e.g., winter) and the atmospheric temperature of the heat pump drying machine is also low, temperature of the air circulating in the air blowing path is accordingly lowered. In order to execute heat exchange of refrigerant with the circulating air, the refrigerant cannot absorb heat (i.e., energy) from the circulating air without controlling the temperature of the refrigerant flowing through the evaporator to be lower than that of the circulating air.

Therefore, the temperature of the refrigerant flowing through the evaporator may be equal to or less than 0° C. until the temperature of the circulating air is increased to a fixed temperature or more. In this case, condensed water generated in the evaporator is frozen there, and the frozen condensed water may block the air blowing path. Consequently, there occurs such a drawback that the air cannot be circulated in both of the accommodation room and the air blowing path, so that the drying efficiency is lowered.

To solve the drawback, the aforementioned conventional technique discloses a configuration that a supercooling pipe is provided to the evaporator to supercool the refrigerant discharged from the radiator. Accordingly, the evaporator is defrosted by means of heat of the refrigerant that flows through the supercooling pipe. In the configuration, however, the heat transfer area of the evaporator is reduced by the amount corresponding to the supercooling pipe. Therefore, there is a problem that operation efficiency in the normal dry operation is lowered.

Furthermore, there is also a problem that the control is cumbersome to implement energy saving without deteriorating an actual drying function.

SUMMARY OF THE INVENTION

The present invention is implemented in view of the above situation, and has an object to provide a heat pump drying machine for achieving energy saving with simple control.

Furthermore, another object of the present invention is to provide a heat pump drying machine for preventing occurrence of frost in an evaporator during an energy saving dry operation without reducing an operation efficiency.

In order to achieve the above objects, according to a first aspect of the present invention, a heat pump drying machine includes an accommodation room for accommodating a drying target and a heat pump having a refrigeration circuit. Here, the refrigeration circuit is constructed by a compressor, a radiator, expansion means, an evaporator and the like. Additionally, the heat pump drying machine is configured to dry the drying target in the accommodation room by making refrigerant discharged from the compressor flow through the radiator, the expansion device and the evaporator and by circulating air in an air blowing path so that the air flows from the radiator to the evaporator via the accommodation room and returns to the radiator. The heat pump drying machine has a first dry operation mode and a second dry operation mode. In the first dry operation mode, a dry operation is executed under a condition that the compression ratio of the compressor is equal to or more than 3.0. In the second dry operation mode, the dry operation is executed under a condition that the compression ratio of the compressor is equal to or more than 2.3 and is less than 3.0. Furthermore, the heat pump drying machine further includes an operation control unit for controlling an operation frequency of the compressor so that the dry operation modes are switched to each other.

According to the above construction, the operation frequency of the compressor is controlled under the condition that the compression ratio is equal to or more than 3.0. Accordingly, the temperature of the refrigerant discharged from the compressor is increased, and the temperature of the air to be supplied to the accommodation room is also increased in response to this increase. Therefore, the first dry operation with a short drying time can be executed. Furthermore, when the operation frequency of the compressor is controlled under the condition that the compression ratio is equal to or more than 2.3 and is less than 3.0, input energy of the compressor is reduced. Therefore, the second dry operation with an enhanced COP can be executed. Consequently, energy saving is achieved with a simple control of changing the compression ratio.

In the first dry operation mode of the above construction, the operation frequency of the compressor may be set to the maximum value allowable in respective states of the refrigeration cycle. According to the construction, the compressor is operated with the maximum capacity. Therefore, the compressor can supply higher-temperature air to the accommodation room. Consequently, the drying time can be shortened.

Furthermore, the refrigerant may be carbon dioxide refrigerant. According to the construction, even when the compression ratio is set to be equal to or more than 2.3 and is less than 3.0, it is possible that the air supplied to the accommodation room after it is heated by the radiator can be kept at a temperature equal to or more than the lowest temperature allowable for drying the drying target. Therefore, the drying function is not deteriorated during the energy saving dry operation.

Moreover, in order to achieve the above objects, according to a second aspect of the present invention, a heat pump drying machine includes an accommodation room for accommodating a drying target and a heat pump that is provided with a refrigeration circuit. Here, the refrigeration circuit is constructed by a compressor, a radiator, an expansion device, an evaporator, and the like. The heat pump drying machine is configured to dry the drying target in the accommodation room by making refrigerant discharged from the compressor operated at a predetermined operation frequency through the radiator, the expansion device and the evaporator, and by circulating air in an air blowing path so that the air flows from the radiator to the evaporator via the accommodation room and returns to the radiator. The heat pump drying machine has a first dry operation mode and a second dry operation mode. In the first dry operation mode, the compressor is operated at the predetermined operation frequency. In the second dry operation mode, the compressor is operated at an operation frequency lower than the predetermined operation frequency. Furthermore, the heat pump drying machine further includes an operation control unit for executing the control of entrapping heat (retention of heat) in the air blowing path in order to remove frost generated in the evaporator during the operation of the second dry operation mode.

According to this construction, the heat pump drying machine includes the operation control unit for executing the control of entrapping heat in the air blowing path in order to remove the frost generated in the evaporator during the operation of the second dry operation mode. Therefore, the temperature of the air flowing into the evaporator is increased in accordance with the increase of the air temperature in the air blowing path. Melting of the frost is thereby promoted, and evaporation temperature of the refrigerant flowing through the evaporator is increased. Consequently, occurrence of frost can be prevented in the evaporator during the second dry operation.

In the above construction, the operation control unit may execute the control of increasing the operation frequency of the compressor to an operation frequency enough to remove the frost generated in the evaporator. According to the above construction, when the compressor is driven under the condition that its operation frequency is increased to the operation frequency enough to remove the frost generated in the evaporator, electric energy for driving the compressor changes into thermal energy and the thermal energy is given to the air in the air blowing path. Retention (entrapment) of heat is thus promoted in the air blowing path. Therefore, the temperature of the air flowing into the evaporator is increased in accordance with the increase of the air temperature in the air blowing path, and melting of the frost is promoted. Simultaneously, evaporation temperature of the refrigerant flowing through the evaporator is increased. Accordingly, generation of frost can be prevented in the evaporator during the second dry operation.

Furthermore, the heat pump drying machine may include temperature detection unit for detecting one of an air inlet port temperature of the accommodation room, an air outlet port temperature of the accommodation room and an atmospheric temperature of the heat pump drying machine. The operation control means may be configured to execute the control of increasing the operation frequency of the compressor to the operation frequency enough to remove the frost generated in the evaporator when the temperature detected by the temperature detection means is lowered than a predetermined frost generation temperature. According to the above construction, when the temperature detected by the temperature detection unit is lowered than the predetermined frost generation temperature, in other words, when frost may occur in the evaporator, the aforementioned operation control is executed. Therefore, reduction in power consumption of the compressor is achieved while generation of frost can be inhibited in the evaporator.

Yet further, the operation control unit may be configured to set the operation frequency, which is enough to remove the frost generated in the evaporator, to the predetermined operation frequency in the first dry operation mode. According to the construction, the heat pump drying machine is merely required to switch the second dry operation mode to the first dry operation mode. Therefore, the operation control can be easily executed.

According to the present invention, the operation frequency of the compressor is controlled in the condition that the compression ratio is equal to or greater than 3.0. Accordingly, temperature of the air to be supplied to the accommodation room is increased in accordance with the increase of temperature of the refrigerant discharged from the compressor. Therefore, the first dry operation with a short drying time can be executed. Furthermore, the operation frequency of the compressor is controlled in the condition that the compression ratio is equal to or greater than 2.3 and is less than 3.0. Accordingly, input energy of the compressor is reduced. Therefore, the second dry operation with an enhanced COP can be executed. Consequently, energy saving is achieved with a simple control of changing the compression ratio.

According to the present invention, the heat pump drying machine includes the operation control unit for executing the control of entrapping heat in the air blowing path in order to remove the frost generated in the evaporator during the operation of the second dry operation mode. Accordingly, the temperature of the air flowing into the evaporator is increased in accordance with the increase of the air temperature in the air blowing path, and melting of frost is promoted. Furthermore, evaporation temperature of the refrigerant flowing through the evaporator is increased. Consequently, occurrence of frost can be prevented in the evaporator during the second dry operation.

DETAILED DESCRIPTION OF THE PREFERRED EMBODIMENTS

With reference to the accompanying figures, an embodiment of the present invention will be hereinafter described in detail.

Figure 1:
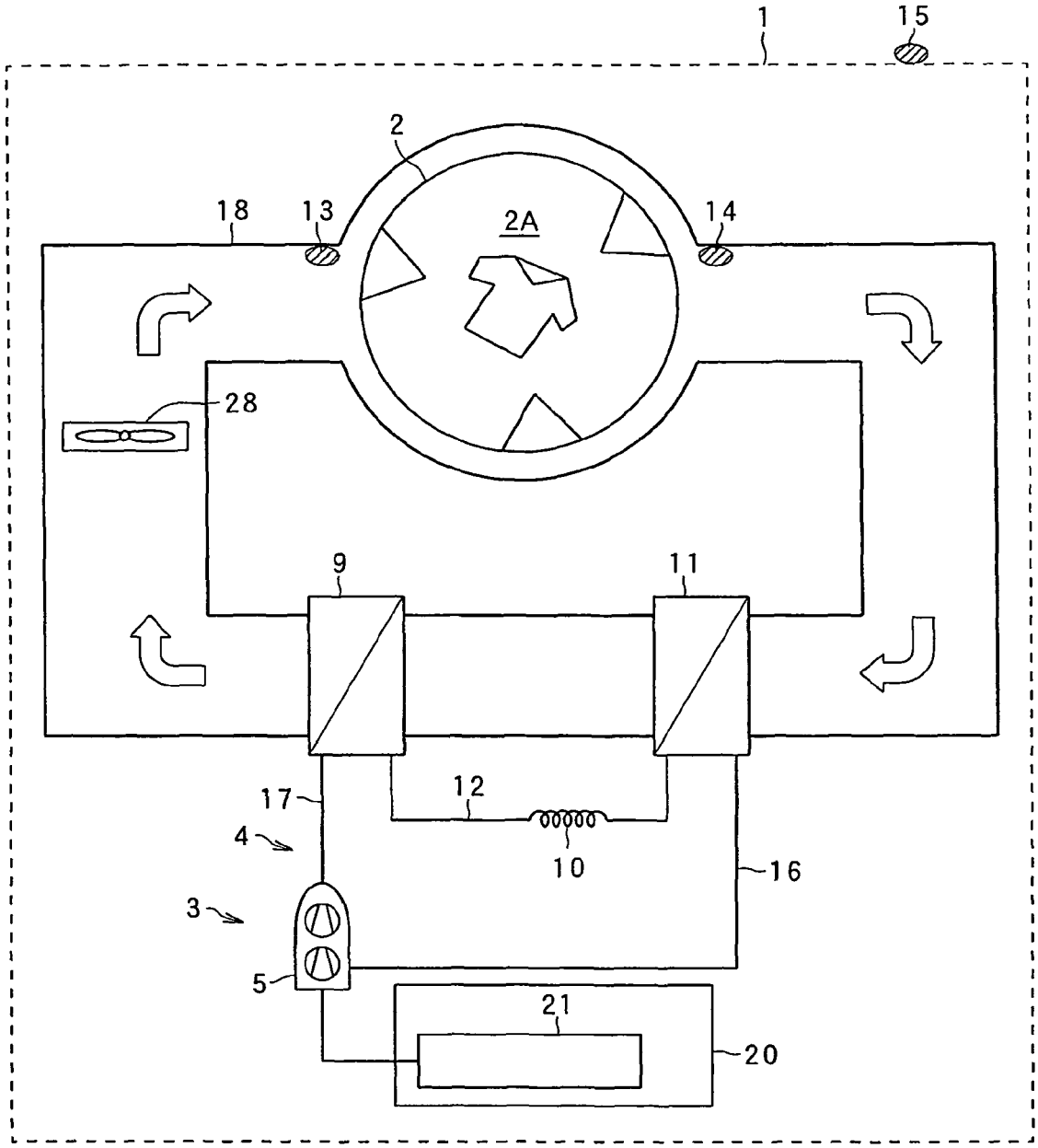
FIG. 1 is a schematic diagram showing the construction a heat pump drying machine.

FIG. 1 illustrates an embodiment of a drying machine to which the present invention is applied.

In FIG. 1, reference numeral 1 represents a heat pump drying machine, and reference numeral 2 represents a cylindrical rotary drum having a large number of apertures formed in the circumferential wall thereof. Clothing (drying target) is dried in an accommodation room 2A at the inside of the drum 2. The drum 2 is rotated by a drum motor (not illustrated in the figure).

Reference numeral 3 represents a heat pump device having a refrigeration circuit 4. The refrigeration circuit 4 includes a compressor 5, a gas cooler 9 functioning as a radiator, a capillary tube (expansion device) 10, an evaporator 11 and the like. Carbon dioxide ($CO_2$) refrigerant is sealingly filled in the refrigeration circuit 4.

The compressor 5 is an inner intermediate-pressure type multi-stage compression rotary compressor which can compress the refrigerant to the supercritical pressure at the high-pressure side of the refrigeration cycle. The compressor 5 also includes a sealed container (not illustrated in the figure) which accommodates an electrically-powered element, a first rotary compression element (first stage) and a second rotary compression element (second stage). The first and second rotary compression elements are driven by the electric-powered element. Low-pressure refrigerant is introduced to the first rotary compression element of the compressor 5 through a refrigerant introduction pipe 16. Then, high-temperature and high-pressure refrigerant which is compressed in the second rotary compression element is discharged from the compressor 5 to the refrigerant discharge pipe 17.

The refrigerant discharge pipe 17 is connected to an inlet port of the gas cooler 9. An outlet port of the gas cooler 9 is connected to an inlet port of the evaporator 11 through a pipe 12. The pipe 12 is provided with the capillary tube 10. An outlet port of the evaporator 11 is connected to an inhalation side of the compressor 5 through the refrigerant introduction pipe 16.

Additionally, a control device (operation control means) 20 provided with an operation mode setting unit 21 and the like controls the operation of the compressor 5. The control device 20 controls an operation frequency of the compressor 5 based on the discharged refrigerant pressure, the air outlet port temperature and the like so as to prevent color change and damage of the drying target that is accommodated in the accommodation room 2A of the drum 2.

On the other hand, an air circulation path (air blowing path) 18 illustrated in the figure is used to circulate the drying air into the drum 2. The air circulation path 18 forms an air flow path in which air flows from the rotary drum 2, successively passes through the evaporator 11, the gas cooler 9 and a fan 28 and then returns to the rotary drum 2. When the fan 28 is operated, a circulation operation is repeated so that air in the drum 2 is sucked out and passed through the evaporator 11 while cooled in the evaporator 11, and then the cooled air is heated in the gas cooler 9 and then is blown into the inside of the drum 2. According to this construction, the high-temperature air heated by the gas cooler 9 is continuously supplied to the inside of the drum 2. Accordingly, the high-temperature air evaporates moisture from the clothing in the drum 2.

The air circulation path 18 is provided with an inlet port temperature sensor 13, an outlet port temperature sensor 14, and a room temperature sensor 15. The inlet port temperature sensor 13 detects an air inlet port temperature which is the temperature of the air flowing into the drum 2. The outlet port temperature sensor 14 detects an air outlet port temperature which is the temperature of the air flowing out of the drum 2. The room sensor 15 detects an atmospheric temperature in the space where the heat pump drying machine 1 is installed. The respective sensors 13 to 15 are connected to the control device 20, and function as temperature detection units.

In this construction, the control device 20 has two kinds of operation modes for the dry operation. One is a normal dry operation mode (first dry operation mode) for driving the compressor 5 at a dry operation frequency (predetermined operation frequency). The other is an energy saving dry operation mode (second dry operation mode) in which the power consumption thereof is less than that of the normal dry operation mode. Any one of these operation modes for the dry operation can be selectively set by the aforementioned operation mode setting unit 21.

Next, the normal dry operation mode and the energy saving dry operation mode will be hereunder described.

Figure 2:
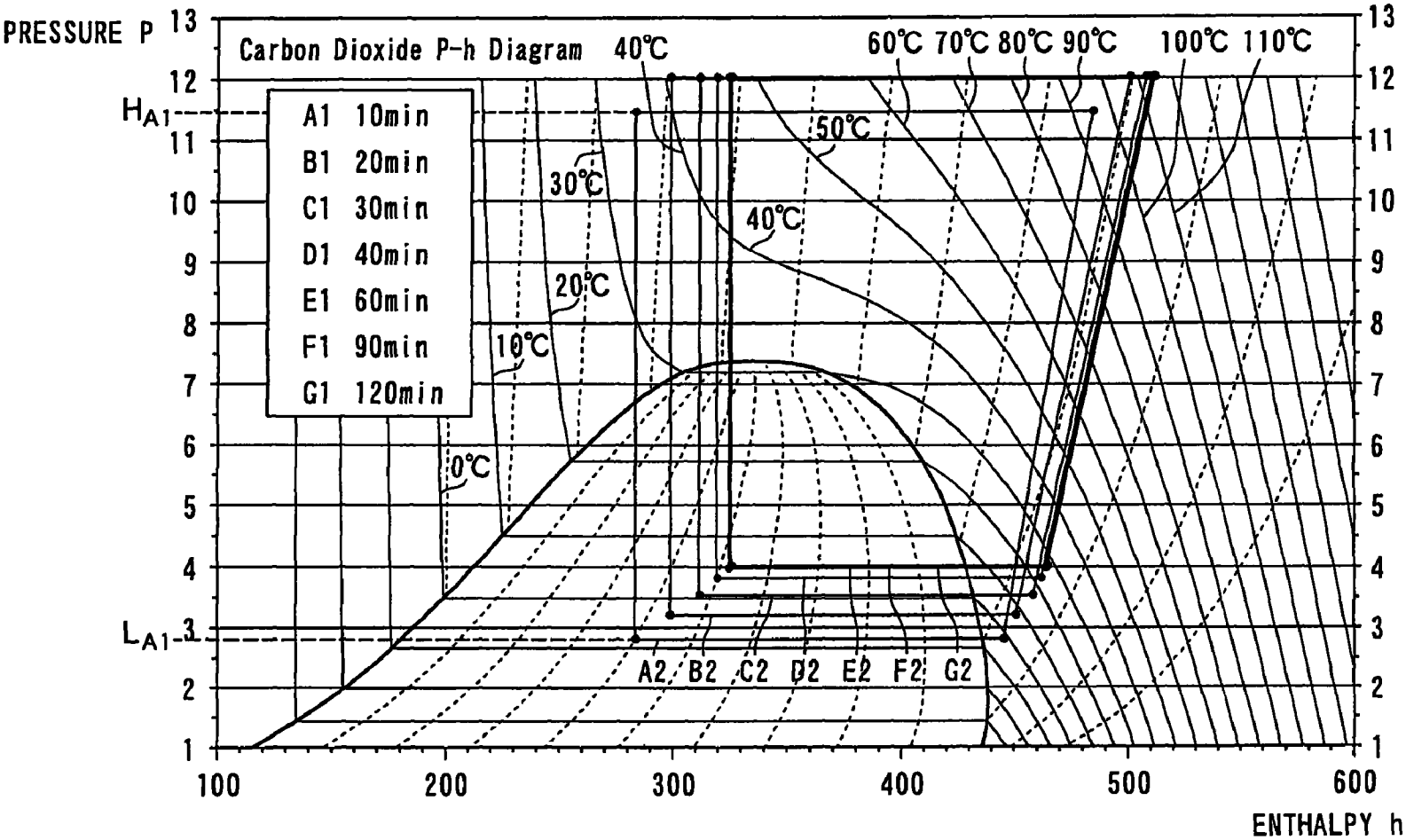
FIG. 2 is a P-h diagram showing the relation between refrigerant pressure P and enthalpy h in a normal dry operation mode.
Figure 3:
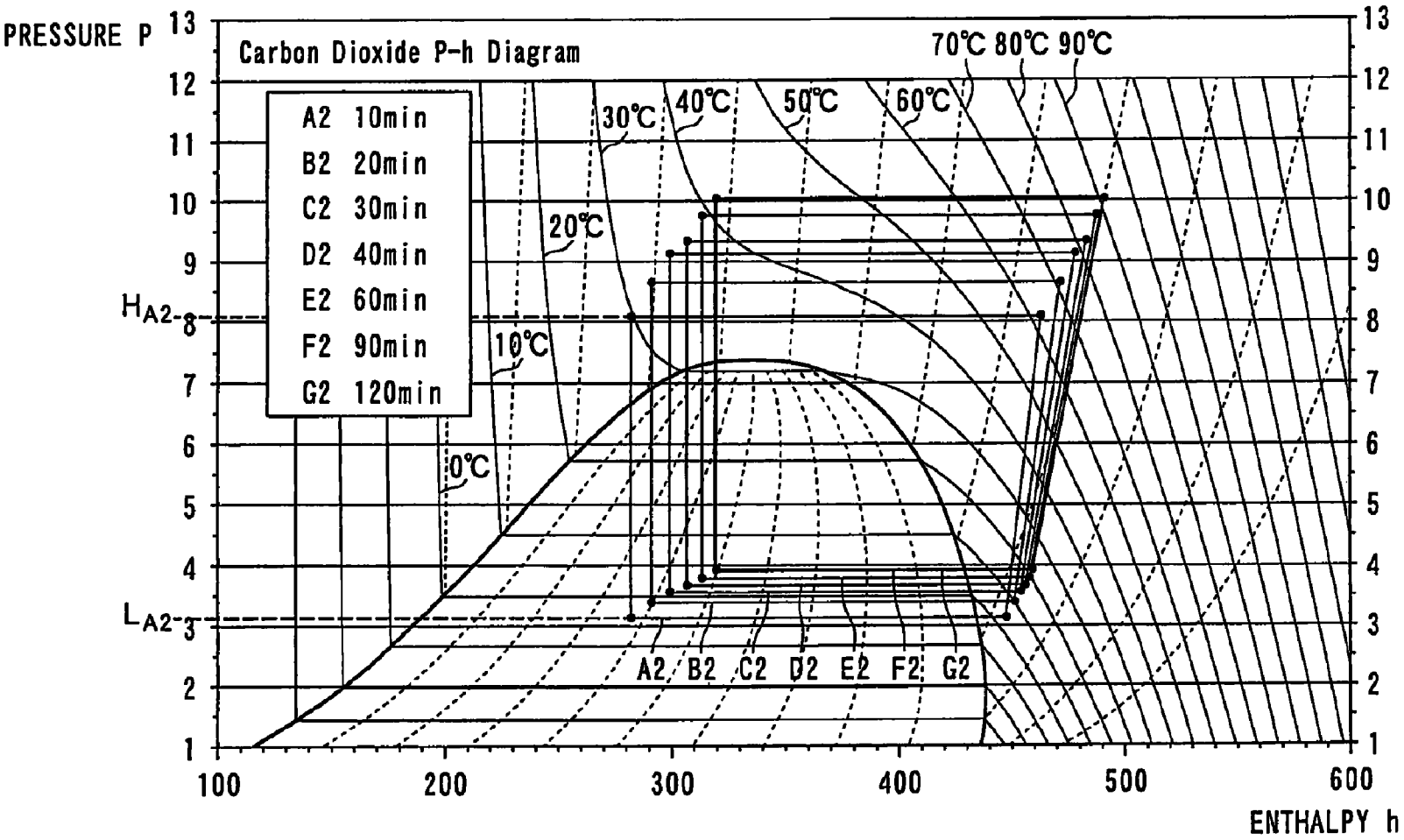
FIG. 3 is a P-h diagram showing the relation between refrigerant pressure P and enthalpy h in an energy saving dry operation mode.

FIG. 2 is a P-h diagram showing the relation between refrigerant pressure P and enthalpy h in the normal dry operation mode. On the other hand, FIG. 3 is a P-h diagram showing the relation between refrigerant pressure P and enthalpy h in the energy saving dry operation mode.

In FIG. 2, reference numerals A1 to G1 represent states of the refrigeration cycle in the normal dry operation mode when each predetermined period of time elapses from the start of the normal dry operation. In FIG. 3, reference numerals A2 to G2 likewise represent states of the refrigeration cycle in the energy saving dry operation mode when each predetermined period of time elapses from the start of the energy saving dry operation. Specifically, the predetermined period of time is set to 10 minutes (A1, A2), 20 minutes (B1, B2), 30 minutes (C1, C2), 40 minutes (D1, D2), 60 minutes (E1, E2), 90 minutes (F1, F2), and 120 minutes (G1, G2).

The normal dry operation mode (time saving mode) is a dry operation mode which aims to shorten the dry operation time. In this mode, the operation of the compressor 5 is controlled so that the refrigerant discharge temperature of the compressor 5 is quickly increased. In order to shorten the dry operation time, it is desirable to continuously supply the air of approximately 80° C. to the accommodation room 2A of the drum 2. In the refrigeration cycle using HFC refrigerant (e.g., R134a or the like), the refrigerant discharge temperature is low, and thus it is difficult to keep the air temperature at approximately 80° C. On the other hand, according to this construction, carbon dioxide refrigerant which his pressurized to the supercritical pressure by the compressor 5 is used. Therefore, the refrigerant discharge temperature can be further increased to be higher than that of the HFC refrigerant. Accordingly, it is possible to keep the air temperature at approximately 80° C. by setting the compression ratio of the compressor 5 in a range of 3.0 or more. Here, the compression ratio is defined as the ratio of the pressure at the discharge side of the second rotary compression element (i.e., high pressure) to the pressure at the suction side of the first rotary compression element (i.e., low pressure).

Specifically, when 10 minutes elapses from the start of operation, the compression ratio corresponds to the ratio of a high pressure HA1 to a low pressure LA1 in the state A1 of the refrigeration cycle. The ratio is obtained as follows.

$$HA1/LA1=11.4/2.7=4.2$$

In this case, the refrigerant discharge temperature exceeds 90° C.

Additionally, when 20 minutes elapse from the start of operation, the compression ratio corresponds to that in the state B1 of the refrigeration cycle. The ratio is obtained as follows.

$$HB1/LB1=11.9/3.2=3.7$$

In this case, the refrigerant discharge temperature reaches approximately 110° C.

Furthermore, when 120 minutes elapse from the start of operation, the compression ratio corresponds to that in the state G1 of the refrigeration cycle. The ratio is obtained as follows.

$$HG1/LG1=12.0/4.0=3.0$$

In this case, the refrigerant discharge temperature is kept at 110° C.

As described above, in the normal dry operation mode, the refrigerant discharge temperature of the compressor 5 can be rapidly increased to about 110° C. by controlling the operation frequency of the compressor 5 so that the compression ratio is equal to or greater than 3.0, preferably, in a range of 3.0 to 4.2. Therefore, the temperature of the air flowing into the drum 2 can be increased to approximately 80° C. by heat-exchanging the air with the high-temperature discharge refrigerant in the gas cooler 9. Consequently, a dry operation of a short drying time is achieved.

In the present embodiment, the operation frequency of the compressor 5 in the normal dry operation mode is set to the maximum value allowable in the respective states of the refrigerant cycle. According to this construction, the compressor 5 is operated with the maximum capacity. Therefore, it is possible to supply higher-temperature air to the drum 2, so that the drying time can be shortened.

On the other hand, the energy saving dry operation mode is a dry operation mode which aims to more greatly reduce the power consumption as compared with the normal dry operation mode. In the energy saving dry mode, the operation of the compressor 5 is controlled to inhibit power consumption of the compressor 5. In this construction, the operation frequency of the compressor 5 is controlled under the condition that the compression ratio is equal to or greater than 2.3 and is less than 3.0 so as to implement energy saving without deteriorating the drying function.

The coefficient of performance (COP) of the refrigerant cycle is calculated on the basis of the ratio of the heat absorption amount B in the evaporator to the electric power amount A applied to the compressor (B/A:cooling COP) or the ratio of the heat discharge amount C in the radiator to the applied electric power amount A (C/A:heating COP). The greater the COP value is, the better the operation efficiency is (i.e., the greater the contribution to energy saving is). From the above standpoint of view, it is more desirable that the compression ratio is smaller .

On the other hand, it is also required to dry clothing within a predetermined period of time in the energy saving dry operation mode. Therefore, the refrigerant discharge temperature is required to be increased to some extent. When the compression ratio is lowered to be smaller than 2.3, the temperature of the air to be supplied to the accommodation room 2A of the drum 2 is increased to approximately 40° C. However, it takes a long time to dry the clothing at the air temperature of the level. Accordingly, the drying function is deteriorated.

According to experiments, etc., it has been found that it is desirable to set the compression ratio of the compressor 5 to a value in a range of 2.4 to 2.7 in the energy saving dry operation mode in consideration of the energy saving and the drying time. Especially, FIG. 3 shows that the optimum value of the compression ratio is 2.6.

In FIG. 3, when 10 minutes elapse from the start of the operation, the compression ratio is obtained as follows.

$$HA2/LA2=8.1/3.1=2.6$$

When 20 minutes elapse after the start of the operation, the compression ratio in the state B2 of the refrigeration cycle is obtained as follows.

$$HB2/LB2=8.6/3.3=2.6$$

When 120 minutes elapse from the start of the operation, the compression ratio in the state G2 of the refrigeration cycle is obtained as follows.

$$HG2/LG2=10.2/3.9=2.6$$

Thus, the operation frequency of the compressor 5 is controlled to be equal to about 2.6.

In the refrigeration cycle of the energy saving dry operation mode, a greater COP is obtained as compared with the normal dry operation mode. Therefore, energy saving can be implemented. Furthermore, the refrigerant discharge temperature of the compressor 5 can be increased to 70° C. or more when 20 minutes elapse from the start of the operation. Therefore, temperature of the air flowing into the drum 2 can be increased to approximately 60° C. by heat-exchanging air with the discharge refrigerant having the temperature of this level in the gas cooler 9. Accordingly, a sufficient drying function can be ensured. Consequently, both of energy saving and reduction in the drying time are simultaneously achieved by operating the compressor under the condition that the compression ratio is set to 2.6. In other words, the energy saving dry operation under the optimum condition can be implemented.

In the refrigeration cycle using HFC refrigerant (e.g., R134a), the compression ratio is required to be increased to about 4.5 even when an operation of keeping the air temperature at approximately 60° C. is executed in the normal dry operation mode. Also, the compression ratio is not lowered to be smaller than 4.0 in the energy saving dry operation mode.

By the way, the compressor is operated at a low operation frequency in the energy saving dry operation mode. When the external temperature is low in some conditions (e.g., winter) and the atmospheric temperature of the heat pump drying machine is low, it takes a long time to increase the temperature of air circulating in the air circulation path.

In this case, the temperature of the refrigerant flowing through the evaporator may be equal to or less than 0° C. until the temperature of the circulating air is increased to a predetermined temperature or more. Therefore, condensed water generated in the evaporator may be frozen there. The frozen water may block the air blowing path. As a result, the air in both of the accommodation room and the air blowing path cannot be circulated. This induces a drawback that the drying efficiency is deteriorated.

According to this embodiment, heat is entrapped in the air circulation path 18 by increasing the operation frequency of the compressor 5 during the operation of the energy saving dry mode. This prevents occurrence of frost in the evaporator 11.

Next, a series of steps of the operation for preventing occurrence of frost will be hereinafter described.

Figure 4:
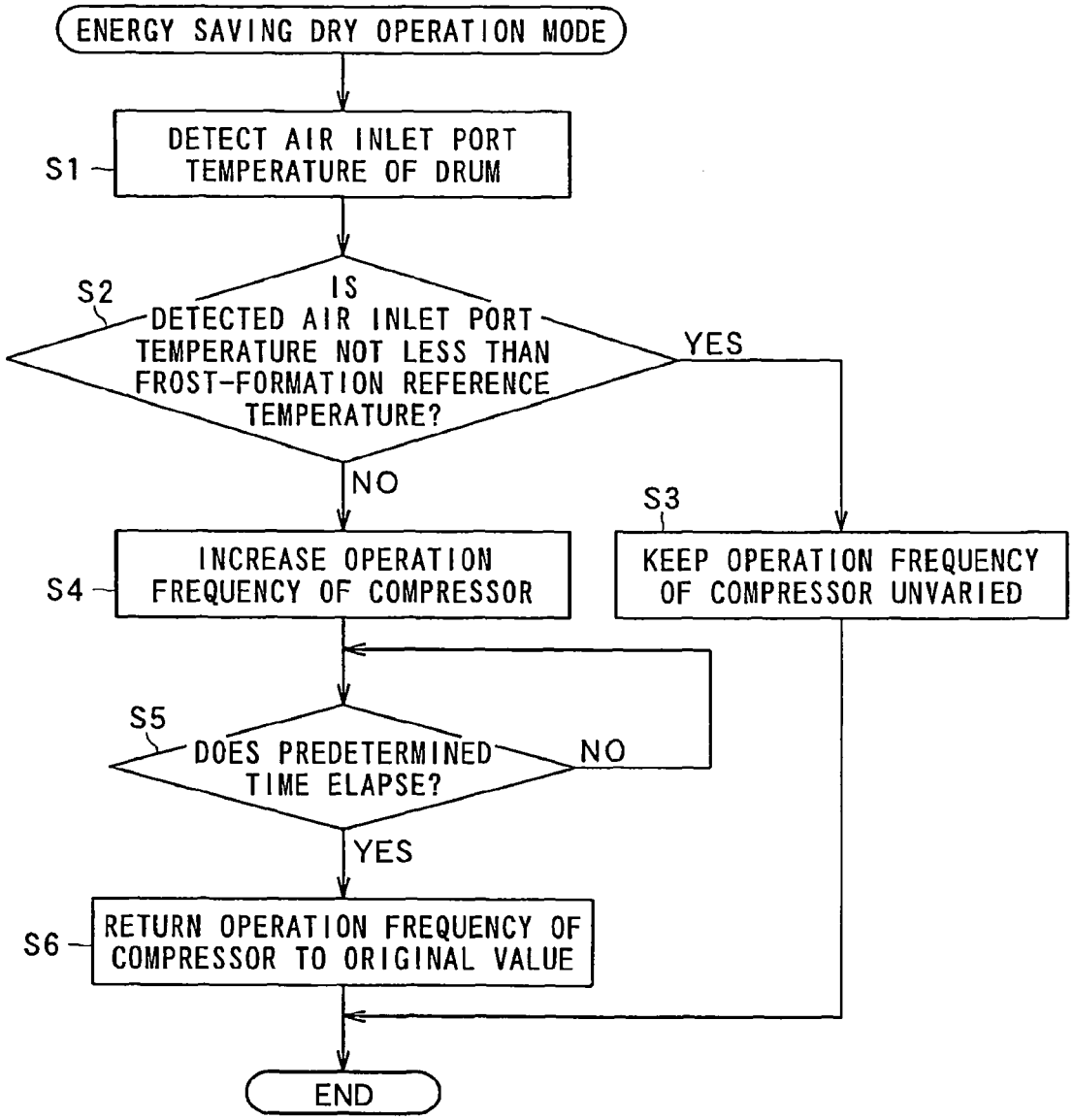
FIG. 4 is a flowchart illustrating a control processing flow.

FIG. 4 is a flowchart illustrating a series of steps of the operation for preventing occurrence of frost.

When the heat pump drying machine 1 is operated in the energy saving dry operation mode, the control device 20 makes the compressor 5 operate at an energy saving operation frequency (40 Hz in the present embodiment), which is suitable for the energy saving dry operation mode.

First, the control device 20 makes the inlet port temperature sensor 13 detect the air inlet port temperature of the drum 2 at the start of or during the operation in the energy saving dry operation mode (Step S1). Next, the control device determines whether or not the detected air inlet port temperature is equal to or more then a predetermined frost generation reference temperature (e.g., 10° C.) (Step S2) . The frost generation reference temperature presents the temperature at which frost occurs in the evaporator 11 when the heat pump device 3 is operated under the temperature environment.

When it is determined that the air inlet port temperature is equal to or more than the predetermined frost generation reference temperature (Step S2; Yes), the probability that frost occurs in the evaporator 11 is low. Accordingly, the control device 20 makes the compressor 5 operate without changing the operation frequency of the compressor 5 (Step S3), and the processing is completed.

Figure 5:
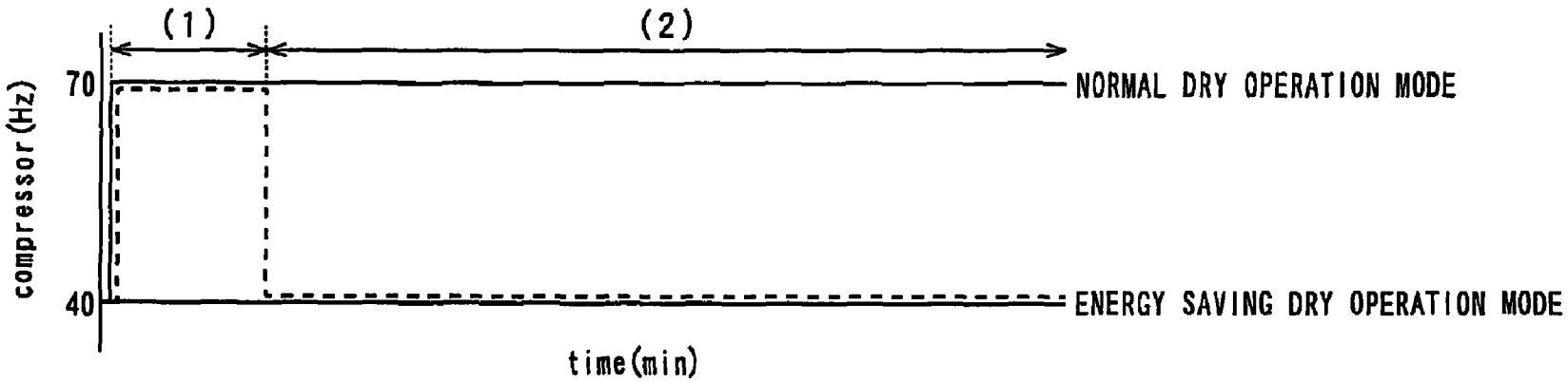
FIG. 5 is a time chart showing a state that an operation frequency varies.

On the other hand, when it is determined that the air inlet port temperature is less than the predetermined frost generation reference temperature (Step S2; No), frost may occur in the evaporator 11 is high. As indicated by a dashed line in FIG. 5, the control device 20 increases the operation frequency of the compressor 5 from the energy saving operation frequency to a frost removal operation frequency enough to remove frost occurring in the evaporator (Step S4). The frost removal operation frequency represents an operation frequency enough to remove frost occurring in the evaporator 11 by operating the compressor 5 at the frequency. In the present embodiment, the frost removal operation frequency is set to the dry operation frequency (e.g., 70 Hz) in the normal dry operation mode.

When heating (by the gas cooler 9) and cooling (by the evaporator 11) are simultaneously executed in a single refrigeration cycle as described in this embodiment, the heat discharge amount at the heating side corresponds to a value obtained by adding the electric power applied to the compressor 5 to the heat absorption amount at the cooling side. Therefore, the heating amount is more than the heat absorption amount. Consequently, retention of energy (heat) corresponding to the electric power applied to the compressor 5 occurs in the air circulation path 18.

Figure 6:
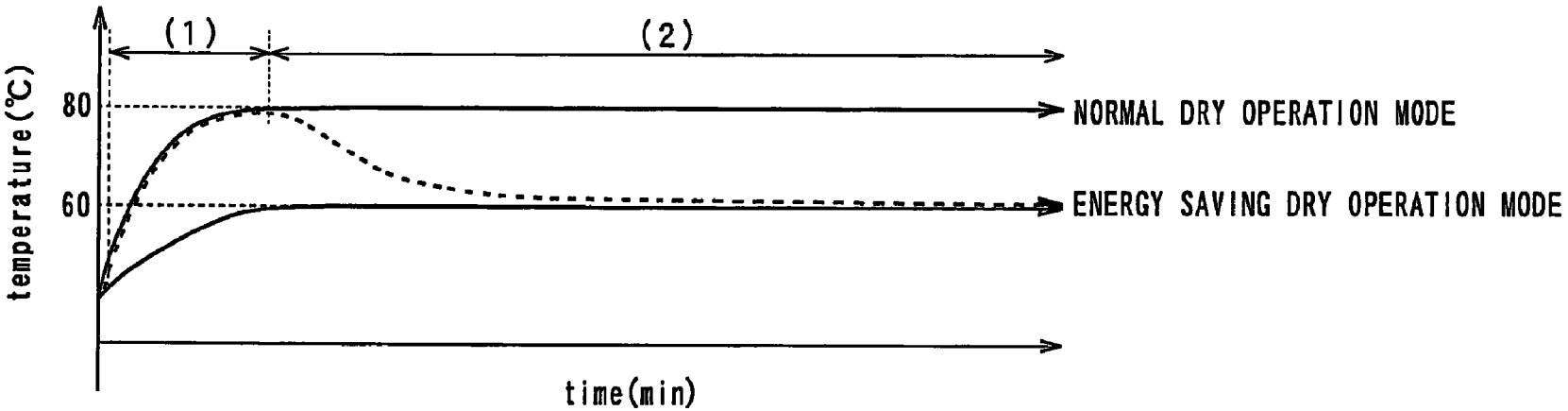
FIG. 6 is a time chart for showing a state that an air inlet port temperature of a drum varies.

In this case, when the operation frequency of the compressor 5 is increased to 70 Hz, the refrigerant discharge temperature of the compressor 5 is increased as described above. Furthermore, electric energy for driving the compressor 5 changes into thermal energy and the thermal energy is given to the air in the air circulation path 18. Accordingly, retention of heat is promoted in the air circulation path 18. According to this construction, as indicated by a dashed line in FIG. 6, the air inlet port temperature of the drum 2 can be increased to approximately 80° C. in a step (1), and the air temperature can be increased in the air circulation path 18. Therefore, the temperature of the air flowing into the evaporator 11 is increased in accordance with the increase of the air temperature, and melting of frost is promoted. Furthermore, the evaporation temperature of the refrigerant flowing through the evaporator 11 is increased. Accordingly, occurrence of frost is prevented in the evaporator 11 during the energy saving dry operation.

Next, the control device 20 determines whether or not a predetermined period of time (e.g., 15 minutes) elapses after the operation frequency of the compressor 5 is increased to the dry operation frequency (Step S5). The predetermined period of time represents a sufficient period of time required to prevent occurrence of frost when the operation frequency of the compressor 5 is increased to the dry operation frequency. The predetermined period of time is set on the basis of experiments, etc. Also, the predetermined period of time varies depending on the operation frequency and the refrigeration cycle, and can be changed to any suitable period of time as needed.

When it is determined that the predetermined period of time has not elapsed yet after the operation frequency of the compressor 5 is increased to the dry operation frequency (Step S5; No), the processing waits until the predetermined period of time elapses. On the other hand, when it is determined that the predetermined period of time has elapsed after the operation frequency of the compressor 5 is increased to the dry operation frequency (Step S5; Yes), the control device 20 sets the operation frequency of the compressor 5 to the original vale (40 Hz) as indicated by the dashed line in FIG. 5 (Step S6). Thus, the processing completes the aforementioned step (1), and proceeds to a step (2) while the operation frequency of the compressor 5 is maintained as described above. Then, processing is completed.

As described above, according to this embodiment, the heat pump drying machine 1 includes the drum 2 (the accommodation room 2A) for accommodating clothing and the heat pump device 3 having the refrigerant circuit 4. The refrigerant circuit 4 includes the compressor 5, the gas cooler 9, the capillary tube 10, the evaporator 11, etc. The heat pump drying machine 1 is configured to dry the clothing inside the drum 2 by making refrigerant discharged from the compressor 5 flow through the gas cooler 9, the capillary tube 10 and the evaporator 11 and by circulating air in the air circulation path 18 so that the air flows from the gas cooler 9 to the evaporator 11 via the inside of the drum 2 and returns to the gas cooler 9. The heat pump drying machine 1 has the normal operation mode and the energy saving dry operation mode. In the normal operation mode, the dry operation is executed under the condition that the compression ratio of the compressor 5 is set to be equal to or more than 3.0. In the energy saving dry operation mode, the dry operation is executed under the condition that the compression ratio is set to be equal to or more than 2.3 and is less than 3.0. The heat pump drying machine 1 also includes the control device 20 for controlling the operation frequency of the compressor 5 so that the respective dry operation modes are switched to each other.

With the construction, when the operation frequency of the compressor 5 is controlled under the condition that the compression ratio is equal to or more than 3.0, the temperature of the air to be supplied to the accommodation room 2A is increased in accordance with the increase of the refrigerant discharge temperature by the compressor 5. Therefore, a normal dry operation of a short drying time is implemented. Furthermore, when the operation frequency of the compressor 5 is controlled under the condition that the compression ratio is equal to or more than 2.3 and is less than 3.0, input energy of the compressor 5 is reduced. Therefore, an energy saving dry operation having an enhanced COP is implemented. Therefore, the energy saving dry operation can be executed with a simple control of changing the compression ratio to implement the energy saving.

Furthermore, in this embodiment, carbon dioxide is used as the refrigerant circulating in the refrigerant circuit 4. With the construction, even when the compression ratio is set to be equal to or more than 2.3 and is less than 3.0, the temperature of the air to be supplied to the accommodation room 2A after it is heated by the gas cooler 9 can be kept to be equal to or more than the lowest temperature for drying the clothing. Therefore, the drying function is not deteriorated during the energy saving dry operation.

Furthermore, according to this embodiment, in the normal dry operation mode, the operation frequency of the compressor 5 is set to the maximum value allowable in respective states of the refrigeration cycle. In other words, the compressor 5 is operated with the maximum capacity. Accordingly, higher-temperature air can be supplied to the inside of the drum 2 (the accommodation room 2A), and the drying time can be shortened.

As described above, the present invention has been described based on the present embodiment, however, the present invention is not limited to the above-mentioned embodiment. For example, in the above embodiment, the heat pump drying machine 1 has the normal dry operation mode and the energy saving dry operation mode as the dry operation mode. However, the construction of the dry operation mode is not limited to the above modes. For example, in addition to the aforementioned modes, the heat pump drying machine 1 may be configured to have a time saving dry operation mode which aims to shorten the drying time of the normal dry operation mode.

In the above embodiment, the heat pump drying machine 1 includes the capillary tube 10 as the expansion device. However, the expansion device is not limited to a specific one described above. For example, the heat pump drying machine 1 may include an electric expansion valve as the expansion device. In this case, the compression ratio may be controlled to the aforementioned value by adjusting the opening degree of the electric expansion valve. Also, in the above embodiment, the heat pump drying machine 1 using the heat pump device 3 has been described. However, the present invention can be applied to a heat pump washer/drying machine combo and a dry cleaner having a washer liquid circulation path (not illustrated in the figure).

Furthermore, according to the above embodiment, the heat pump drying machine 1 includes the drum 2 for accommodating clothing and the heat pump device 3 having the refrigerant circuit 4. The refrigerant circuit 4 includes the compressor 5, the gas cooler 9, the capillary tube 10, the evaporator 11 and the like. The heat pump drying machine 1 is configured to dry the clothing by making refrigerant discharged from the compressor 5 operated at the dry operation frequency flow through the gas cooler 9, the capillary tube 10 and the evaporator 11 and by circulating air in the air circulation path 18 so that the air flows from the gas cooler 9 to the evaporator 11 via the inside of the drum 2 and returns to the gas cooler 9. The heat pump drying machine 1 has the normal dry mode and the energy saving dry mode. In the normal dry mode, the compressor 5 is operated at the dry operation frequency. In the energy saving dry mode, the compressor 5 is operated at the energy saving operation frequency that is lower than the dry operation frequency. The heat pump drying machine 1 further includes the control device 20 for executing a control of increasing the operation frequency of the compressor 5 to the dry operation frequency during the operation of the energy saving dry mode. With this construction, when the compressor is driven under the condition that the operation frequency is increased to the dry operation frequency, electric energy for driving the compressor changes into thermal energy, and the thermal energy is given to the air in the air circulation path 18. Accordingly, retention (entrapment) of heat is promoted in the air circulation path 18. Therefore, temperature of the air flowing into the evaporator 11 is increased in accordance with the increase of the air temperature in the air circulation path 18. This promotes melting of frost. Furthermore, evaporation temperature of the refrigerant flowing through the evaporator 11 is increased. Accordingly, frost formation can be prevented in the evaporator 11 during the energy saving dry operation.

Furthermore, according to the present embodiment, the heat pump drying machine 1 includes the inlet port temperature sensor 13 for detecting the air inlet port temperature of the drum 2, and the control device 20 executes the control of increasing the operation frequency of the compressor 5 from the energy saving operation frequency to the dry operation frequency when the air inlet port temperature detected by the inlet port temperature sensor 13 is lowered than the predetermined frost generation reference temperature. With this construction, when frost may occur in the evaporator 11, execution of the operation control makes it possible to inhibit occurrence of frost in the evaporator 11 and to reduce power consumption of the compressor 5.

Furthermore, according to the above embodiment, the control device 20 executes the control of increasing the operation frequency of the compressor 5 from the energy saving operation frequency to the dry operation frequency as the frost removal operation frequency. Accordingly, when it is desired to avoid occurrence of frost, it is implemented by merely switching the energy saving dry operation mode to the normal dry operation mode . In other words, the operation control can be easily executed.

Moreover, according to the above embodiment, the control device 20 is configured to increase the operation frequency of the compressor 5 from the energy saving operation frequency to the dry operation frequency as the frost removal operation frequency. However, it should be understood that the frost removal operation frequency may be set independently of the dry operation frequency insofar as occurrence of frost can be avoided.

Furthermore, according to the above embodiment, the heat pump drying machine 1 is provided with the capillary tube 10 as the expansion device. However, the expansion device is not limited to the capillary tube 10. For example, the heat pump drying machine 1 may be provided with an electric expansion valve as the expansion device. In this case, the electric expansion valve functions as means for entrapping heat in the air circulation path 18 by restricting the opening degree of the electric expansion valve. In addition to this, retention (entrapment) of heat is further effectively achieved by increasing the operation frequency of the compressor.

Also, according to the above embodiment, the heat pump drying machine 1 is provided with the inlet port temperature sensor 13 for detecting the air inlet port temperature of the drum 2 in order to detect the air temperature, which is used as a reference for determining whether or not frost is generated in the evaporator 11. However, the sensor being used is not limited to the above style. For example, the outlet port temperature sensor 14 for detecting the air outlet port temperature of the drum 2 and the room sensor 15 for detecting the atmospheric temperature may be used for detecting the reference air temperature.

Also, according to the above embodiment, the operation control to increase the operation frequency of the compressor 5 from the energy saving operation frequency to the dry operation frequency as the frost removal operation frequency is configured to be completed after a predetermined period of time elapses. However, the operation control is not limited to this style. For example, the operation control may be configured to be completed when evaporation temperature of the evaporator 11 reaches a predetermined temperature (e.g., 5° C.). Alternatively, the operation control may be configured to be completed when the air outlet port temperature of the drum 2 reaches a predetermined temperature (e.g., 40° C.). According to this construction, the operation control can be further minutely executed. Therefore, it is possible to enhance the energy saving effect.

Also, the heat pump drying machine 1 using the heat pump device 3 has been described in the above embodiment. However, the present invention can be applied to a heat pump washer/drying machine combo or a dry cleaner that is provided with a washer liquid circulation path (not illustrated in the figure). Furthermore, carbon dioxide refrigerant is used as the refrigerant in the above embodiment. However, any suitable refrigerant (e.g., R134a) may be used as the refrigerant.

What is claimed is:

1. A heat pump drying machine which comprises an accommodation room for accommodating a drying target and a heat pump having a refrigeration circuit constructed by a compressor, a radiator, an expansion device and an evaporator and in which the drying target is dried in the accommodation room by making refrigerant discharged from the compressor operated at a first operation frequency flow through the radiator, the expansion device and the evaporator and by circulating air in an air blowing path so that the air flows from the radiator to the evaporator via the accommodation room and returns to the radiator, wherein the heat pump drying machine has a first dry operation mode for operating the compressor at a first operation frequency and a second dry operation mode for operating the compressor at a second operation frequency, the second operation frequency being lower than the first operation frequency, and the heat pump drying machine further comprises an operation control unit that switches the operation mode of the compressor between the first operation mode and the second operation mode by switching the operation frequency of the compressor between the first operation frequency and the second operation frequency, and when a defrosting operation is executed on the evaporator during the second dry operation mode, the operation control unit increases the operation frequency of the compressor from the second operation frequency up to an operation frequency enough to remove frost occurring in the evaporator so that heat is entrapped in the air blowing path and the frost occurring in the evaporator is removed.

2. The heat pump drying machine according to claim 1, wherein the operation control unit increases the operation frequency of the compressor from the second operation frequency up to the first operation frequency of the first dry operation mode.

3. The heat pump drying machine according to claim 1, further comprising a temperature detection unit for detecting one of an air inlet port temperature of the accommodation room, an air outlet port temperature of the accommodation room, and an atmospheric temperature of the heat pump drying machine, wherein the operation control unit executes control of increasing the operation frequency of the compressor from the second operation frequency up to the first operation frequency of the first dry operation mode when the temperature detected by the temperature detection unit is lower than a predetermined frost formation temperature.

4. The heat pump drying machine according to claim 1, wherein the first dry operation mode is a mode for executing the dry operation under a condition that a compression ratio of the compressor is equal to 3 or more and the second dry operation mode is a mode for executing the dry operation under a condition that the compression ratio of the compressor is set in a range from 2.3 to less than 3.

5. The heat pump drying machine according to claim 1, wherein the refrigerant is carbon dioxide refrigerant.

* * * * *